United States Patent [19]

Wessel et al.

[11] 4,210,106

[45] Jul. 1, 1980

[54] METHOD AND APPARATUS FOR REGULATING A COMBUSTIBLE MIXTURE

[75] Inventors: Wolf Wessel, Oberriexingen; Wilfried Sautter, Ditzingen, both of Fed. Rep. of Germany

[73] Assignee: Robert Bosch GmbH, Stuttgart, Fed. Rep. of Germany

[21] Appl. No.: 910,916

[22] Filed: May 30, 1978

Related U.S. Application Data

[63] Continuation of Ser. No. 732,124, Oct. 13, 1976, abandoned.

[30] Foreign Application Priority Data

Oct. 13, 1975 [DE] Fed. Rep. of Germany ..... 2545759

[51] Int. Cl.[2] ..... F02B 3/00

[52] U.S. Cl. ..... 123/489; 123/472; 60/276; 60/285

[58] Field of Search ..... 123/32 EE, 32 EA; 60/276, 285

[56] References Cited

U.S. PATENT DOCUMENTS

| | | | |
|---|---|---|---|
| 2,389,797 | 11/1945 | MacNeil et al. | 123/32 EE |
| 3,782,347 | 1/1974 | Schmidt et al. | 123/32 EE |
| 3,875,907 | 4/1975 | Wessel et al. | 123/32 EE |
| 3,903,853 | 9/1975 | Kizler et al. | 60/276 |
| 3,919,983 | 11/1975 | Waal et al. | 60/285 |
| 3,949,551 | 4/1976 | Eichler et al. | 60/274 |
| 3,984,976 | 10/1976 | Nagai | 60/276 |
| 3,990,411 | 11/1976 | Oberstadt et al. | 123/32 EA |
| 4,019,474 | 4/1977 | Nishimaya et al. | 123/32 EE |
| 4,030,462 | 6/1977 | Sasayama et al. | 60/285 |
| 4,099,491 | 7/1978 | Reddy | 123/32 EE |

*Primary Examiner*—Charles J. Myhre
*Assistant Examiner*—Raymond A. Nelli
*Attorney, Agent, or Firm*—Edwin E. Greigg

[57] ABSTRACT

A fuel metering control loop which includes an exhaust gas sensor and an integrating controller. In order to operate the system at an air number which may differ from the most stable operating point of the oxygen sensor, the output signal from the controller is deliberately changed so as to override the command signals from the oxygen sensor. In particular, the output signal undergoes a step-change toward a higher or lower value at the times of reversal of sensor potential. Thus, the average value of the air number which the controller effectively maintains is different from the nominal value which would be obtained with direct sensor control. In another embodiment, the ongoing integration process is continued for some time beyond the sensor signal reversal.

6 Claims, 4 Drawing Figures

METHOD AND APPARATUS FOR REGULATING A COMBUSTIBLE MIXTURE

This is a continuation, of application Ser. No. 732,124, filed Oct. 13, 1976 and now abandoned.

BACKGROUND OF THE INVENTION

The invention relates to a method and an apparatus for performing the method of changing the mass ratio of the fuel-air mixture delivered to an internal combustion engine (λ-control). The regulation takes place with the aid of an oxygen sensor whose output potential is fed to an integrating controller which adjusts the metered out fuel quantity.

In known systems of this type, the mass ratio, i.e., the air number λ of a fuel-air mixture fed to an internal combustion engine is changed in dependence on the composition of the exhaust gas. In the known system, a λ sensor or oxygen sensor is exposed to the exhaust gas stream and generates an output voltage in dependence on the exhaust gas composition; its time behavior and effects will be discussed further below. The output voltage of the λ sensor is fed to a controller, preferably an integrating controller, which causes an increase or decrease of the instantaneous fuel fed to the engine as a function of the output signal from the sensor. A change in the air number of the fuel-air mixture in the manner described above can be performed in engines having carburetors as well as those having fuel injection systems although the latter are normally better able to meter out the fuel quantity with precision. In such a control system, the engine itself is part of the control loop so that the dead time of the control loop will be that of the engine throughput time $T_t$ which is a quantity that changes constantly, especially as a function of the engine speed, i.e., rpm.

A parameter of considerable importance in any control loop which uses the output potential of an oxygen sensor is the characteristic of that sensor which is illustrated schematically in FIG. 1 and which, once properly warmed up, exhibits two different switching states. The first of these switching states corresponds to an output voltage of approximately, for example, 900 mV and takes place when the fuel-air mixture to which the sensor is exposed in the exhaust system is rich, while the second output potential is approximately 100 mV and is experienced when the fuel-air mixture is originally lean. The transition between these two sensor potentials is very abrupt and occurs substantially when the air number λ has the value λ=1. In a practical exemplary embodiment, the change between the two states takes place in finite time, however the characteristic curve at the value λ=1 permits regulation to very lightly enriched air numbers only if a sufficiently high threshold value is given. In addition to this disadvantage, operation on the bent part of the curve which is less steep than the other portions of the curve has the further disadvantage that this portion of the curve is temperature-dependent and subject to the effects of ageing. A substantially stable characteristic point of the curve is encountered in presently available sensors at a sensor output voltage $U_S$ of approximately 300 to 350 mV as indicated by the point P in FIG. 1. However, if it is intended actually to use the point P of the sensor curve, then one is forced to operate at a particular value of the air number λ. On the other hand, it is desirable to include the possibility of varying the domain of operation by at least plus or minus 5 percent around the value λ=1 so that the engine operation may be freely chosen to take place approximately between λ=0.95 up to λ=1.05.

OBJECT AND SUMMARY OF THE INVENTION

It is a principal object of the invention to provide a method for changing the mass ratio of the fuel-air mixture fed to an internal combustion engine in a λ-control loop in which the stable characteristic operating point on the sensor curve can be chosen as a threshold value, yet suitable variations of the air number λ are nevertheless possible.

It is another object of the invention to provide an apparatus for carrying out the above-described method.

These and other objects are attained according to the invention by performing the above-described method with the additional provision of altering the time behavior of the output voltage from the controller in opposition to any previously described shape and direction at a point of time which coincides with a change in the oxygen sensor output voltage. The change of the controller voltage is such that on the average and independently on the engine throughput time occurring during operation (dead time $T_t$), there takes place a shift to a controlled λ value which is different from the λ value actually occurring at the time of switch-over as determined by the λ sensor.

The arbitrarily adjustable change of the time behavior of the output voltage from the integral controller, which may, for example, be fed to the final control element of the fuel metering system, permits to so change the characteristic of the integral controller that, when a λ sensor or an oxygen sensor is used to operate in any arbitrary intermediate value of λ, it is possible to maintain control both on the relatively rich as well as the relatively lean side of that chosen value of λ. In this manner, lean running programs with a predetermined value of λ as well as programs for operation at λ less than 1 can be realized with only an insignificant increase in fuel consumption, if necessary with air injection. It is normally generally desirable to be able to change the air number λ during the operation of an internal combustion engine either in its basic setting or, if necessary, during operation. The method and apparatus according to the present invention make it possible to change the operating value of the air number even in dependence on the rpm, for example by affecting, in a manner to be explained later, trimmer elements of the integrating controller which affect its output voltage in dependence on rpm.

The invention will be better understood as well as further objects and advantages thereof become more apparent from the ensuing detailed description of two exemplary embodiments taken in conjunction with the drawing.

DESCRIPTION OF THE PREFERRED EMBODIMENTS

Before discussing the invention and its exemplary embodiments in detail, it should be noted that the invention is usable in any and all systems which are capable of changing the fuel-air ratio from a predetermined value, for example by means of a final control element which is actuated by the output voltage of a controller. Thus, even the most widely differing carburetors, for example, could be altered in their settings by mechanical setting elements, for example magnetically controlled valves or the like, so that the amount of fuel delivered is changed as a function of the sensor voltage.

It is particularly advantageous however to use the method and apparatus of the present invention in an electronic fuel injection system which may be so embodied, for example, that it delivers electrical opening pulses to fuel injection valves, and in which the duration of the opening pulses is changeable. Normally, these injection valves are supplied with fuel at constant pressure so that the duration of the opening pulses determines the amount of fuel fed to the engine either continuously or per operating stroke. An electronic fuel injection system of this type can provide an electronic controller which activates a final power stage that opens the injection valves, where the electronic controller generates output pulses whose duration determines the opening time of the injection valves, i.e., determines the length of the final control pulses. The controller itself can include as principal switching element a monostable multivibrator having a timing capacitor in a feedback path. Thus, for example, the unstable time constant of the monostable multivibrator is determined by the recharging time of the capacitor which, in turn, is defined by the effect of charging and discharging current sources. The discharging current is related to the air quantity fed to the engine, which may be detected in any suitable manner and transduced accordingly, while the charging current is related to the actual rpm of the engine, i.e., it is synchronous with the rpm. It is not necessary to discuss in detail the specific construction of the electronic portion of the fuel injection system as long as the overall fuel injection system is so constructed that a changing input voltage can change the fuel quantity fed to the engine in an appropriate manner which is the only essential requirement for the application of the present invention.

Figure 1:
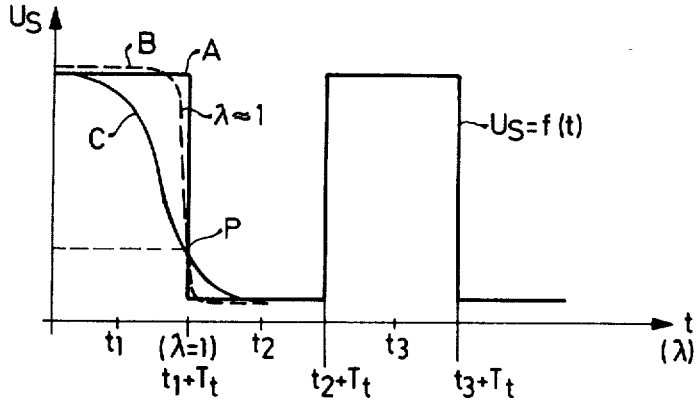
FIG. 1 is a diagram showing the dependence of the oxygen sensor output voltage $U_S$ as a function of time for a changing fuel-air mixture.

Turning now to FIG. 1, there will be seen a curve A which illustrates the ideal operation of a λ sensor used in an electronic fuel injection system and delivering a sensor potential $U_S$ depending on the exhaust gas composition. Also shown in FIG. 1 is the actual sensor potential B as a function of the air number λ as well as a curve C which indicates the characteristic sensor potential when temperature and aging effects are taken into account. It will be seen that the characteristic curve is very steep at the value $\lambda=1$ and somewhat more shallow at $\lambda\sim1$. Basically, however, it will be noted that all of the curves include the point P which can be considered to be stable with respect to temperature and aging and which is the point that is used as the threshold value in the present invention. For this purpose, the apparatus of the invention includes a sensor threshold circuit which will be explained further below. The output voltage of the threshold circuit is then fed to an integrating controller which will be described in detail below whose own output is a changing voltage which is delivered to the fuel injection system in the above-described manner for the purpose of adjusting the fuel quantity fed to the engine.

The overall operation of the invention will now be explained with the aid of FIGS. 2*a* to 2*c*.

At the time t1 of FIG. 1 the value of the fuel-air mixture delivered by a customary λ-controller which uses an oxygen sensor and an integral controller passes that value of λ which the characteristic curve is forced to produce, namely $\lambda=1$. This mixture is aspirated by the engine and processed in the usual manner but reaches the sensor only after the motor throughput time $T_t$ which then signals the occurrence of the value $\lambda=1$ at a time equal to $t1+T_t$ by changing its output potential. The integrating controller which, until this time, had continued to adjust the mixture, now begins to regulate in the opposite direction so that, at the time t2, it again delivers a fuel mixture whose actual value of λ is $\lambda=1$, but, as before, this condition of the engine is sensed by the oxygen sensor only at the time $t2+T_t$ so that the fuel-air mixture constantly oscillates about a median value of $\lambda=1$.

In some cases however, for example when employing a one stage catalyzer for reducing the toxic components of the exhaust gas, it is preferable to operate the engine with a fuel-air mixture whose λ value is 0.99, and it is desirable to be able to operate the control loop so as to attain this value by shifting the median value of λ about which the system oscillates. This change is performed by altering the shape of the output signal from the integrating controller.

Figure 2:
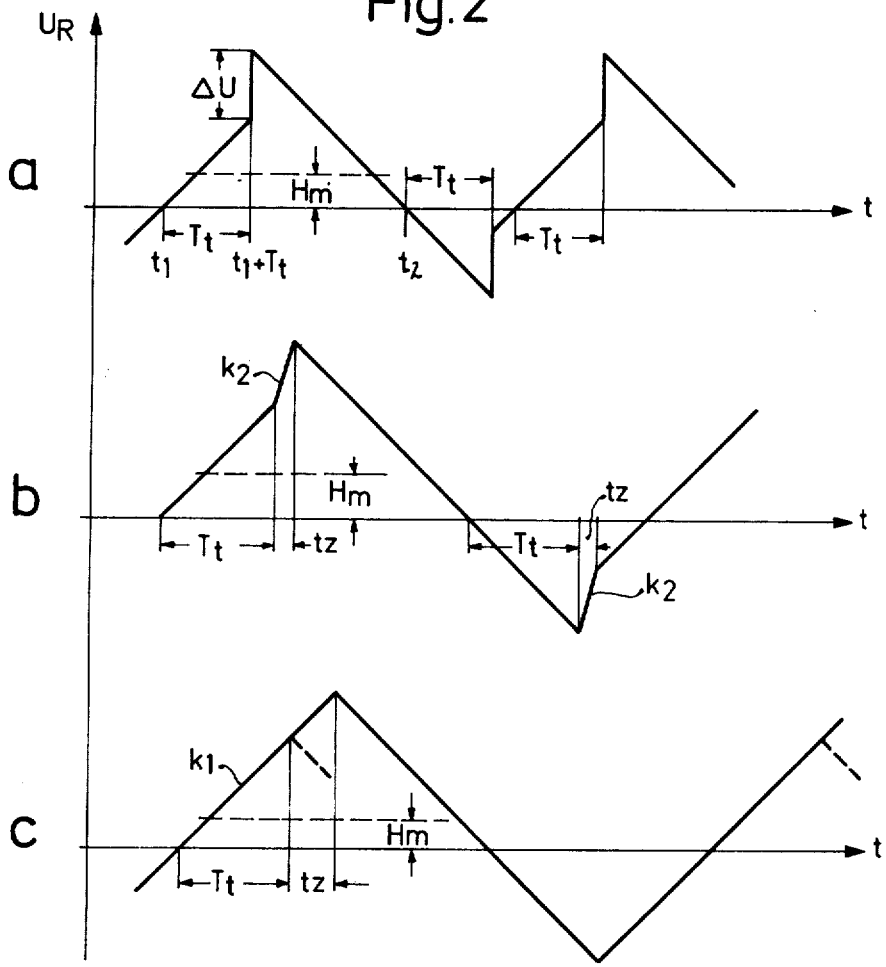
FIGS. 2*a, b, c* illustrate the time behavior of the controller output voltage $U_R$ as a function of time in dependence on the sensor voltage $U_S$.

The manner in which the output signal from the controller may be altered is illustrated in a first exemplary embodiment in FIG. 2*a* which shows the output voltage from the integrating controller $U_R$ as a function of time. At the time t1, the air number of the fuel-air mixture is 1 but the λ sensor cannot yet respond to that fact because it senses the occurrence of that value only after the motor throughput time $T_t$ has elapsed. Thus, as previously explained, at a point $t1+T_t$, the output signal is so altered as to attain a preliminary shift by a value ΔU so as to change the median value of λ. After having undergone this abrupt change, the controller then regulates the fuel-air mixture in the opposite direction and its output signal passes zero at a time t2. At the time $t2+T_t$, the λ sensor again signals the presence of the value $\lambda=1$; the output voltage is again shifted abruptly upwardly as before, so that there takes place an average displacement $H_m$ of the controller output voltage by a value equal to $\Delta U/2$. This shift is independent of the magnitude of the motor throughput time $T_t$. While it is technically difficult to produce an abrupt shift of the voltage with substantially infinite slope, it is not difficult to approach such a function to any desired degree of accuracy. FIG. 2*b* illustrates a potential shift performed with finite slope. During each potential alternation of the oxygen sensor, FIG. 2*b* shows an increase of the output voltage $U_R$ of the integral controller which is performed during an additional time period $t_z$. In this case, the average shift is also independent of $T_t$ and is equal to $$H_m=k_2\cdot t_z/2,$$

where $k_2$ is the slope of the potential change during the time $t_z$. Thus, by a suitable choice of $k_2$ and $t_z$, any desired shift can be obtained. It will be understood that the shift can also take place in the opposite direction if it is desired for any reason to operate the engine with a leaned-out fuel-air mixture.

It is also possible, as a special case of the exemplary embodiment of FIG. 2*b*, to continue the integration by the controller with the original slope $k_1$ beyond the time at which the sensor alternates its potential. In that case, as can be seen from the figure, a given shift $H_m$ would require a somewhat longer additional time $t_z'$. It may be that, for practically useful shifts, for example $H_m \triangleq 0.5\%\ \lambda$, the additional time $t_z'$ might have the same order of magnitude as the motor throughput time $T_t$ so that the entire control loop is seriously affected and might produce engine bucking and other undesirable phenomena.

Figure 3:
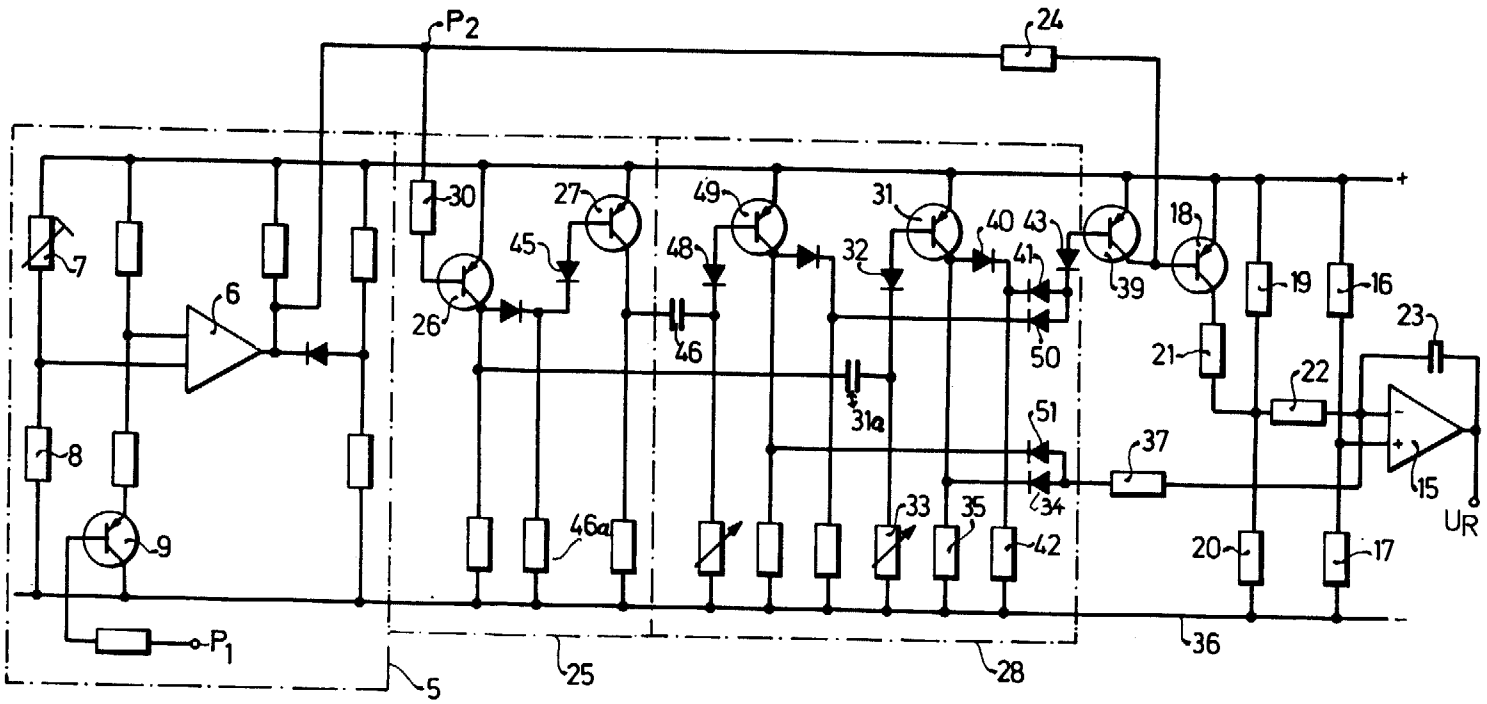
FIG. 3 is a circuit diagram of a first exemplary embodiment of an apparatus for changing the controller characteristics.

Turning now to FIG. 3, there is illustrated the schematic circuit diagram of an apparatus capable of performing the above-described potential shifts while using an oxygen sensor which changes output potential at the value $\lambda=1$, and thereby produce a fuel-air mixture different, on the average, from $\lambda=1$.

The circuit illustrated in FIG. 3 includes a threshold circuit 5 which will not be explained in great detail but which is provided to deliver to the subsequent integrating controller a sensor switching voltage which alternates in potential whenever the actual sensor output voltage $U_s$ passes the stable characteristic point P in FIG. 1. To generate this threshold voltage, there is provided a comparator 6 one of whose inputs receives a fixed voltage from an adjustable voltage divider circuit including resistors 7 and 8 and whose other input receives the sensor output voltage $U_s$ from an input contact P1 via a transistor 9. The output of the comparator 6 at the contact P2 is a square wave which jumps from one value to the other when the value of $\lambda$ passes $\lambda=1$. The integrating controller includes an operational amplifier 15 whose non-inverting input receives a constant voltage from a voltage divider composed of resistors 16 and 17 and whose inverting input receives a voltage which changes according to the sensor threshold voltage and is delivered through a voltage divider composed of resistors 19 and 20, suitably influenced by a transistor 18. The collector of the transistor 18 is connected to a resistor 21, in turn coupled with the junction of the resistors 19 and 20 which is also connected through a resistor 22 to the inverting input of the integrator 15. The inverting input is also connected to the output via a capacitor 23 which is the integrating capacitor of the circuit and the integrator delivers an output voltage $U_R$. The base of the transistor 18 receives the output voltage of the sensor threshold circuit 5.

In order to adapt the integrating characteristic of the integrator 15 to the curves of FIGS. 2*a* to 2*c*, there is provided an inverter circuit 25 including transistors 26 and 27 as well as a flip-flop circuit 28 whose function will be explained together with a description of its construction. When an alternation of the output voltage from the sensor threshold circuit 5 passing through the resistor 30 causes the transistor 26 of the first inverter circuit to be negative and conducting, the base of the transistor 31 receives a positive potential shift via the capacitor 31*a*, i.e., the diode connected in series with the base of the transistor 31 is blocked so that the transistor 31 also blocks. The transistor 31, the coupling capacitor 31*a* and an adjustable drain resistor 33 together comprise a monostable flip-flop, i.e., a so-called economy mono, whose time constant is defined by the values of the capacitor 31*a* and the resistor 33. Thus, one can adjust the time during which the transistor 31 is blocked. As soon as the transistor 31 does block, a diode 34 connected to its collector becomes conducting since it is effectively connected to the minus bus 36 through a resistor 35, so that a current flows from the inverting input of the comparator 15 through the resistor 37 connected to the diode 34. Depending on the magnitude of the current flowing through the resistor 37, the output voltage of the integrator 15 rapidly approaches more positive values so that the characteristic of FIGS. 2*a* and 2*b* is substantially attained. In order to make this process independent of the normal slope of the integrating process, there is provided a transistor 39, controlled by the output of the transistor 31. When the transistor 31 is blocked, a diode 40 connected to its collector also blocks and the junction of the diode 40 and a further diode 41 moves to a more negative potential because this junction is connected via a resistor 42 to the minus line 36. A further diode 43 connected between the anode of the diode 41 and the base of the transistor 39 causes the transistor to conduct and thus practically shorts out the input signal present at the base of the transistor 18 so that this transistor is blocked since the collector of the transistor 39 is connected to the base of the transistor 18. In this manner, the integrating characteristic of the integrator 15 is determined exclusively by the values of the resistors 37 and 35 during the unstable state of the economy mono flip-flop comprising substantially the transistor 31.

Thus, the slope k2 in the above formula for the potential shift $H_m$ can be changed by appropriate dimensioning of the resistor 37. The duration of the delay, i.e., the additional time $t_z$ which elapses before the integrator operates in the opposite direction, is also changeable by appropriate dimensioning of the time constant of the economy mono.

The above-described correction or change of the output voltage from the integrator is to take place whenever the integrator 15 would begin to operate in the opposite sense. In the exemplary embodiment of FIG. 3, this time occurs when the input voltage at the point 2 becomes positive. In that case, the transistor 26 blocks and the transistor 27 conducts because its base is connected through a diode 45 and a resistor 46*a* to the minus line 36. The voltage jump at the collector of the transistor 27 is transmitted via a capacitor 46 and a diode 48 to the base of a subsequent transistor 49 which constitutes a second economy mono flip-flop which blocks in this direction of integration. Inasmuch as the collector of the transistor 49 is connected through diodes 50 and 51 to the same circuit elements as already described above, the just described process is repeated.

It should be noted at this point that the entire process may also take place in the opposite sense; for this purpose the circuit would remain substantially the same and only the inputs of the integrator would have to be exchanged. In a similar manner, the type of transistors and the polarity of the supply lines has been chosen merely as a matter of illustration and the circuit operates in an identical way if the polarities of the transistor and the types of transistors are suitably changed.

The fact that the normal slope defined by the transistor 18 is suppressed during the potential shift has the further advantage that the slopes at the upper and lower points of reversal, i.e., for example the slope $k_2$ in FIG. 2*b*, are the same.

Figure 4:
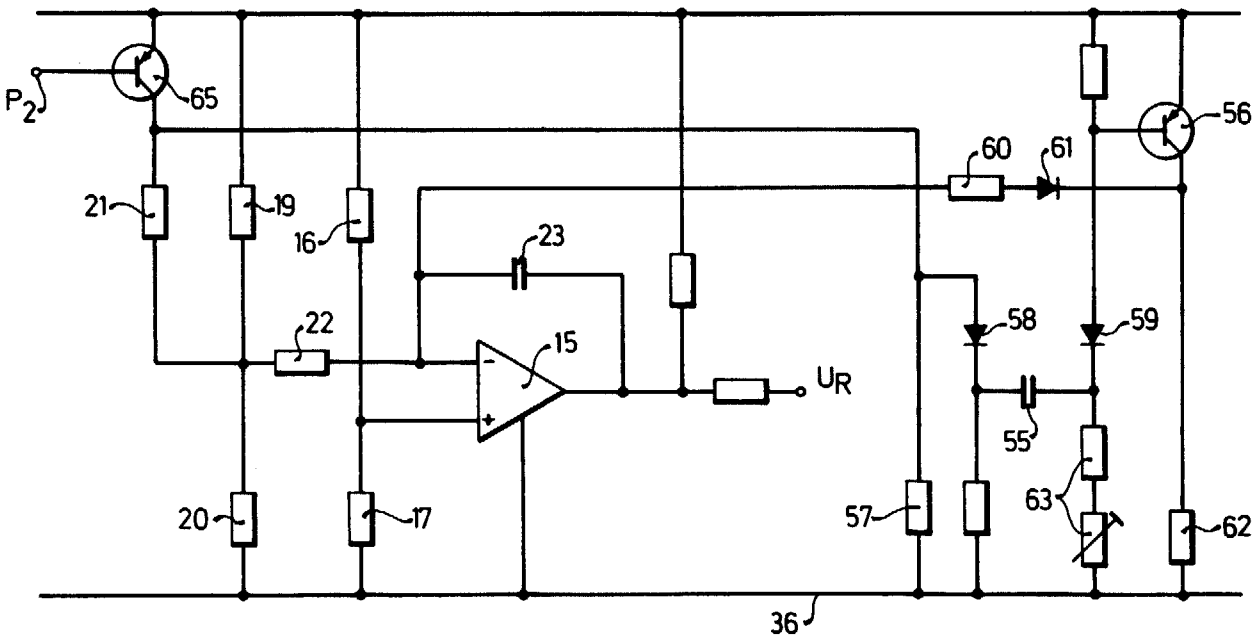
FIG. 4 is a simplified circuit diagram of a second exemplary embodiment for changing the controller characteristics.

A second simplified exemplary embodiment is illustrated in FIG. 4. In this exemplary embodiment the original, i.e., normal, slope of the integrating process is left unchanged and, as already described above, the integration process is merely continued, for example in the positive direction of the output, for a predetermined length of time while the negative reversal is not affected by the circuit of FIG. 4. Those elements which are identical to elements in FIG. 3 retain the same reference numerals. The output voltage of the sensor threshold circuit is delivered at a circuit contact P2 to the base of a transistor 65 which has no direct influence on the integrating characteristics of the integrator 15. If the transistor 65 is made conducting, a positive voltage jump appears at the collector resistor 57 and is transmitted through a diode 58 to a coupling capacitor 55. A diode 59 in the base circuit of the transistor 56 blocks, thereby blocking the transistor 56. Thus, a current flows from the inverting input of the integrator 15 through a resistor 60 and a series diode 61 through the collector resistor 62 to the negative line 36. When the transistor 65 becomes conducting, the input of the integrator 15 receives additional current through the resistor 21 but the resistor 60 is so chosen that the current taken from the input of the integrator 15 is twice as large as the current provided to the integrator due to the conduction of the transistor 65. Thus, the current flow is the same as that taking place during a normal output voltage increase so that the positive direction of the integrator output is maintained until the monostable flip-flop, composed of the transistors 56, the capacitor 55 and the resistor 63, returns to its stable state. Thus, even though the transistor 65 designates a downward integration during this time, the integrator 15 continues to regulate upwardly so that it delivers the output voltage illustrated in FIG. 2*c*. In the opposite direction of integration, there is no corresponding influence because the integrator continues to integrate in that sense anyway.

Thus, the method and apparatus according to the invention is capable of obtaining stable control even when the oxygen sensor has aged and when the effects of the constantly changing exhaust gas temperatures make it impossible to maintain a sensor threshold voltage required for an optimum concentration of the exhaust gas. The invention makes use of the stable sensor point which lies at approximately 300 mV but is able to maintain the median control point at a value which differs from that λ value corresponding to the 300 mV point of the curve.

The foregoing relates to preferred embodiments of the invention, it being understood that numerous other embodiments and variants are possible within the spirit and scope of the invention, the latter being defined by the appended claims.

What is claimed is:

1. An apparatus for regulating the fuel-air mixture of an internal combustion engine, said apparatus including
   an oxygen sensor disposed in the exhaust system of said engine;
   an integrating controller connected to said oxygen sensor to receive first signals therefrom and to generate a second signal for adjusting the engine fuel-air mixture the improvement comprising:
   a comparator connected to receive said first signals and having a comparison threshold adjusted to correspond to a stable operating point of said oxygen sensor;
   timing means, triggered by said comparator, for defining a period of time during which said second signal shall be altered; and
   circuit means, controlled by said timing means, for changing the slope and direction of said second signal during said period of time.

2. An apparatus as defined by claim 1, wherein said integrating controller includes an operational amplifier having a capacitor connected between its output terminal and one of its input terminals and wherein said circuit means for changing said second signal includes voltage divider means connected to a second input of said operational amplifier, first transistor means, connected to said voltage divider means and also connected to said comparator to be controlled thereby and second transistor means, connected to and controlled by said timing means for nullifying the effect of said first transistor during said period of time.

3. An apparatus as defined by claim 1, wherein said timing means includes a monostable flip-flop having transistors and wherein said apparatus further includes a current path between one of the inputs of said operational amplifier and a source of potential, said current path being controlled by said timing means; whereby the magnitude of said current path determines the slope of said second signal from said integrating controller without changing its direction.

4. An apparatus as defined by claim 1, wherein said timing means includes inverter circuits and two subsequent monostable flip-flops connected to said integrating operational amplifier in such a manner that the second signal is affected in the same manner during both switching states of said comparator; whereby the slope of said second signal is changed during the unstable time period of one of said two monostable flip-flops.

5. An apparatus as defined by claim 1, further comprising a switching transistor controlled by said comparator for controlling one input of said integrating controller and a second switching transistor whose collector is connected to said input of said integrating controller and including means for delaying the switching of said second switching transistor; whereby, during said delay, the current delivered to said integrating controller is changed to thereby achieve continued integration at constant slope.

6. In a method for regulating the fuel-air mixture of an internal combustion engine which includes the steps of:
   sensing the oxygen content of the exhaust gases of the engine and providing a first signal;
   feeding said first signal to an integrating controller to generate a second signal which is used to regulate the fuel quantity delivered to the engine;
   the improvement comprising the steps of:
   delaying the arrival time of said first signal to said integrating controller to alter said second signal by permitting said controller to continue to operate in its previous direction for a predetermined period of time after said first signal has undergone polarity reversal thereby simulating a different control point value of said first signal, wherein said second signal is so altered that during a predetermined period of time said second signal is abruptly increased in slope and in the direction of attaining said average regulated fuel-air ratio which is different from that obtained without altering said second signal.

* * * * *